US009708881B2

(12) United States Patent
Xu et al.

(10) Patent No.: US 9,708,881 B2
(45) Date of Patent: Jul. 18, 2017

(54) FRACK PLUG WITH TEMPORARY WALL SUPPORT FEATURE

(71) Applicant: Baker Hughes Incorporated, Houston, TX (US)

(72) Inventors: YingQing Xu, Tomball, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 308 days.

(21) Appl. No.: 14/047,238

(22) Filed: Oct. 7, 2013

(65) Prior Publication Data

US 2015/0096740 A1 Apr. 9, 2015

(51) Int. Cl.
*E21B 33/128* (2006.01)
*E21B 33/129* (2006.01)
*E21B 29/00* (2006.01)

(52) U.S. Cl.
CPC ..... *E21B 33/1293* (2013.01); *E21B 33/128* (2013.01); *E21B 29/00* (2013.01)

(58) Field of Classification Search
CPC ..... E21B 33/1204
See application file for complete search history.

(56) References Cited

U.S. PATENT DOCUMENTS 3,054,450 A * 9/1962 Baker, Jr. ..... E21B 33/1295 166/120
4,146,093 A * 3/1979 Horvath ..... E21B 33/1295 166/120
4,735,268 A 4/1988 Harris et al.
5,333,685 A 8/1994 Gilbert
5,425,424 A 6/1995 Reinhardt et al.
6,026,903 A 2/2000 Shy et al.
6,145,593 A 11/2000 Hennig
6,568,470 B2 5/2003 Goodson, Jr. et al.
6,926,089 B2 8/2005 Goodson et al.
7,152,673 B2 12/2006 Lohbeck
7,533,721 B2 * 5/2009 Sorhus ..... E21B 23/02 138/89
7,661,470 B2 2/2010 Doane et al.
8,267,177 B1 * 9/2012 Vogel ..... E21B 33/1294 166/131
8,459,344 B1 * 6/2013 Stone ..... E21B 33/12 166/114
8,985,224 B1 * 3/2015 Stone ..... E21B 21/10 166/188

(Continued)

FOREIGN PATENT DOCUMENTS

WO 2008151315 A2 12/2008

*Primary Examiner* — Robert E Fuller
*Assistant Examiner* — Steven MacDonald
(74) *Attorney, Agent, or Firm* — Steve Rosenblatt

(57) ABSTRACT

In a fracturing application a packer for a given zone to be fractured is reinforced during fracturing with an insert that is preferably a sleeve. During times of high collapse pressure loading, the sleeve provides the needed support. When fracking is over the liner sleeve is caused to disappear. The preferred material is controlled electrolytic materials but other materials that can disappear when the anticipated loading is diminished can also be used. The disappearing can be motivated chemically or thermally among other contemplated methods. As a result, there is a larger available bore when production is ready to start.

22 Claims, 2 Drawing Sheets

(56) References Cited

U.S. PATENT DOCUMENTS

| | | | | |
|---|---|---|---|---|
| 2005/0205265 | A1* | 9/2005 | Todd | E21B 33/12 166/376 |
| 2011/0136707 | A1 | 6/2011 | Xu et al. | |
| 2011/0297400 | A1 | 12/2011 | Pessin et al. | |
| 2012/0103135 | A1* | 5/2012 | Xu | B22F 1/02 75/233 |
| 2012/0234561 | A1* | 9/2012 | Hall | E21B 33/16 166/386 |
| 2012/0279700 | A1* | 11/2012 | Frazier | E21B 33/129 166/193 |
| 2012/0312561 | A1* | 12/2012 | Hallundæk | E21B 29/10 166/387 |
| 2013/0000914 | A1 | 1/2013 | Kelbie et al. | |
| 2013/0240200 | A1* | 9/2013 | Frazier | E21B 33/129 166/135 |
| 2013/0240201 | A1* | 9/2013 | Frazier | E21B 33/134 166/135 |
| 2013/0240203 | A1* | 9/2013 | Frazier | E21B 33/129 166/193 |
| 2013/0248194 | A1* | 9/2013 | Huang | E21B 21/103 166/332.3 |
| 2014/0246209 | A1* | 9/2014 | Themig | E21B 43/14 166/374 |

* cited by examiner

FRACK PLUG WITH TEMPORARY WALL SUPPORT FEATURE

FIELD OF THE INVENTION

The field of the invention is temporary structural support for tubulars to allow them to withstand large loads during an initial part of their service life and smaller loads later such that a flow path diameter is maximized when the greater strength is no longer needed.

BACKGROUND OF THE INVENTION

Fracturing methods commonly involve a technique of starting at the well bottom or isolating a portion of the well that is not to be perforated and fractured with a plug. The first zone is then perforated and fractured and then another plug is placed above the recently perforated zone and the process is repeated in a bottom up direction until all the zones are perforated and fractured. At the end of that process the collection of barriers are milled out. To aid the milling process the plugs can be made of non-metallic or composite materials. While this technique is workable, there was still a lot of time spent to mill out even the softer bridge plugs and remove that milling debris from the wellbore.

In the past there have been plugs used that are milled out as described in U.S. Pat. No. 7,533,721. Some are forcibly broken to open a passage such as in U.S. Pat. No. 6,026,903. Other designs created a plug with material that responded to a magnetic field as the field was applied and removed when the field was removed. This design was described in U.S. Pat. No. 6,926,089 and 6,568,470. In a multi-lateral application a plug was dissolved from within the whipstock to reopen the main bore after the lateral was completed. This is described in U.S. Pat. No. 6,145,593. Barriers that assist in extending telescoping passages and then are removed for access to fracture the formation are described in U.S. Pat. No. 5,425,424. Longitudinally extending radially expanded packers to get them to release is shown in U.S. Pat. No. 7,661,470.

In a variation of the above designs US Publication 2013/0000914 discusses a thin wall mandrel that is then expanded to enlarge the passage through the mandrel as a way of increasing production after sequential fracturing is over. While this design addressed the need for a larger bore diameter for subsequent production, the design still had issues with collapse resistance when the packer was set and the pressures used in fracturing were applied to the annular space causing an excessive compressive collapse force on the frack packer mandrel.

More recently a design to temporarily support a shear component in a shear plane has been described by William Hered and Jason Barnard in an application called Reinforced Shear Components and Methods of Using Same. Here a disc was interposed in the shear plane and retained in position against a bias force. At a predetermined time the bias force was allowed to move the disc out of the shear plane so that the structure was weakened in the shear plane and the desired failure could occur in the shear plane to release two members to move relatively.

The present design seeks to address the need for compressive strength against external pressures that would otherwise cause a collapse while at the same time addressing the later need for a larger flow diameter for subsequent production where the fracking was done and there no longer was a need to hold back against compressive collapse forces from outside the mandrel. This is accomplished without a need for expansion. A tubular insert is made of structural tubular materials preferable controlled electrolytic materials or CEM. Controlled electrolytic materials have been described in US Publication 2011/0136707 and related applications filed the same day. The related applications are incorporated by reference herein as though fully set forth. After the packer is set in tension and subjected to fracturing forces it no longer needs high collapse resistance and the CEM sleeve is removed to make a larger flow diameter for subsequent production. Although a fracturing example is used illustratively to describe how the invention operates, those skilled in the art will appreciate that other applications are envisioned where a tubular structure responds to differing pressure conditions at different times in a service life. For example in the fracking situation the anticipated tensile load for production is about 30,000 to 50,000 pounds force and for fracturing can be orders of magnitude higher. Those skilled in the art will better appreciate these and other aspects of the present invention from the detailed description and the associated drawings while recognizing that the full scope of the invention can be obtained from the appended claims.

SUMMARY OF THE INVENTION

In a fracturing application a packer for a given zone to be fractured is reinforced during fracturing with an insert that is preferably a sleeve. During times of high collapse pressure loading, the sleeve provides the needed support. When fracking is over the liner sleeve is caused to disappear. The preferred material is controlled electrolytic materials but other materials that can disappear when the anticipated loading is diminished can also be used. The disappearing can be motivated chemically or thermally among other contemplated methods. As a result, there is a larger available bore when production is ready to start.

DETAILED DESCRIPTION OF THE PREFERRED EMBODIMENT

Figure 1:
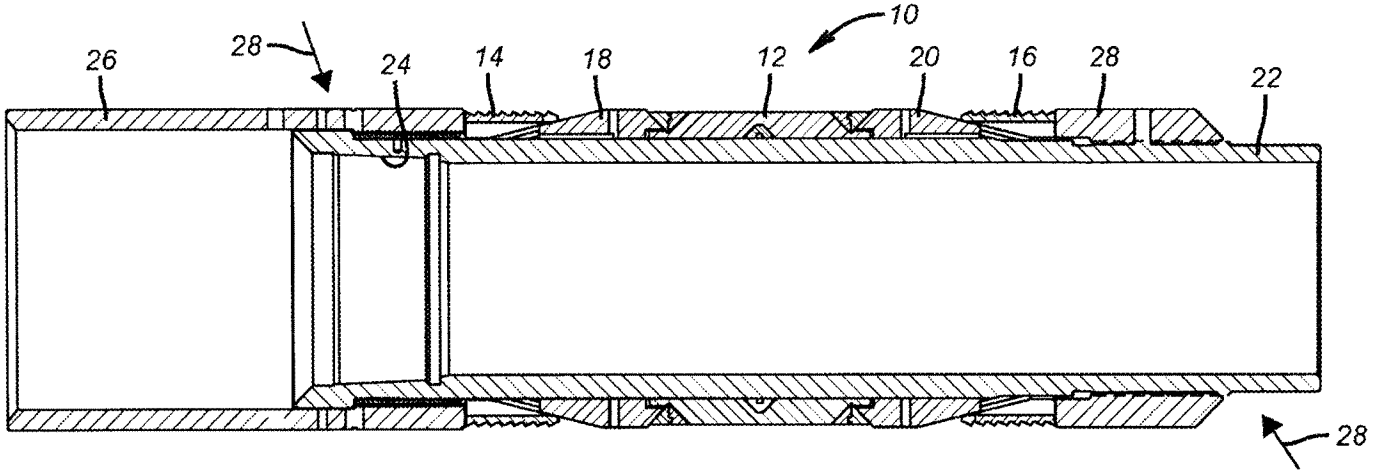
(PRIOR ART) FIG. 1
FIG. 1 is a section view of a prior art isolation device set with relative movement between a mandrel and a housing.

Before describing the present invention in great detail, a brief review of the current state of the art will be useful. FIG. 1 illustrates a packer 10 having a seal 12 and upper slips 14 and lower slips 16 that ride up cones 18 and 20, respectively. Mandrel 22 is engaged by a setting tool that is not shown at profile 24 while the setting tool moves sleeve 26 so that sleeve 26 moves toward ring 28 that is held fixed by the setting tool that is not shown. As a result the mandrel 22 is put into about 30,000 to 50,000 pounds of force in tension. As a result of such relative movement the seal 12 and the slips 14 and 16 are extended to anchor the packer 10 and seal around it to the borehole wall. The FIG. 1A design simply omits the top anchor slip 14 but in all other ways is identical to the design of FIG. 1.

Figure 1A:
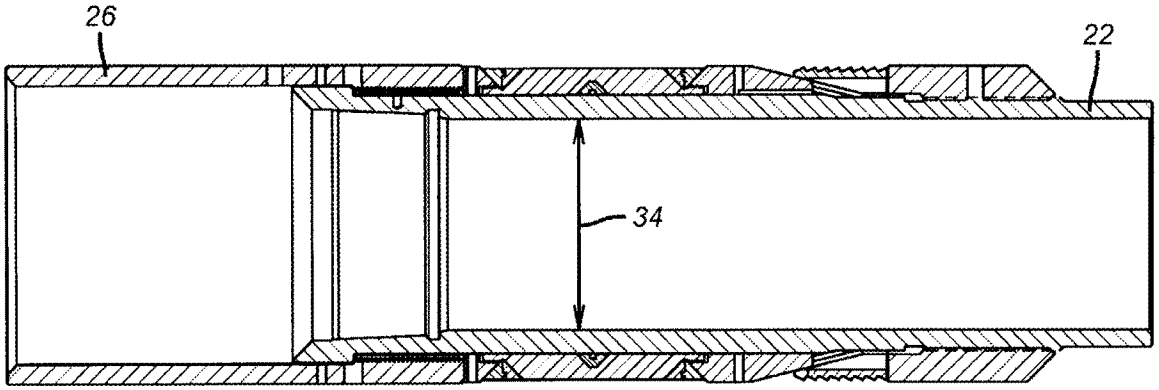
(PRIOR ART) FIG. 1A
FIG. 1A is the view of FIG. 1 with an alternative arrangement for the prior art isolation device that removes the upper slip.
Figure 2:
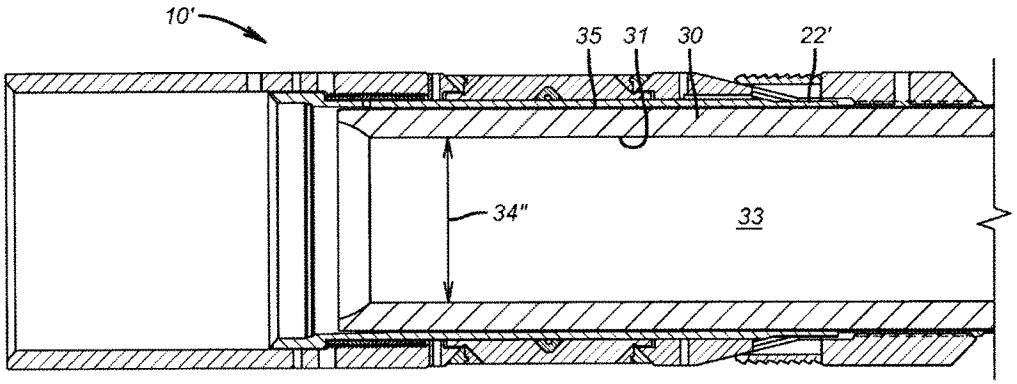
FIG. 2 is a section view of the present invention with a thin mandrel supported internally by a sleeve to provide collapse resistance during fracking operations.

The issue that has been discovered with the designs of FIGS. 1 and 1A is that after packer 10 is set and a ball is circulated down to land on ball seat (both are not shown) at the top of mandrel 22 to create a pressure barrier. When the fracking process is begun the pressures in the annular space around the packer 10 are so high that there is a great deal of collapse force, represented by arrows 28 such that the mandrel 22 is prone to collapse under this differential pressure between the annular space and internally to the mandrel 22. The problem with adding wall thickness to the mandrel 22 is that the reduced drift of the passage through the mandrel 22 will impede later production flow, which is not desirable. Other options like using exotic materials to gain greater collapse strength add significant costs to each packer 10. In a very long interval for fracking there can be dozens of such packers that allow the interval to be fracked in increments. Thus the overall job cost goes up to an unacceptable degree. Prior solutions that are described above used expansion to increase the flow bore but in these designs the tradeoff was the expense and extra time to accomplish the expansion while still leaving the problem of a lack of collapse resistance. Other solutions involving springs to urge discs out of shear planes in unrelated applications had no ready application to the problem addressed by the present invention due to the particular performance requirements of the tools in question. In essence, the principle issue is different performance requirements for a tool at different times in a context where addressing one performance requirement at one time does not defeat the purpose of the tool at a later time. Stated differently, a simple solution had to solve two conflicting problems that could affect tool performance at different times.

The preferred embodiment illustrates this concept in a packer but is applicable to other tools particularly in situation where the need to tolerate pressure differentials conflicts with the need to enhance the flow regime through the tool.

Figure 3:
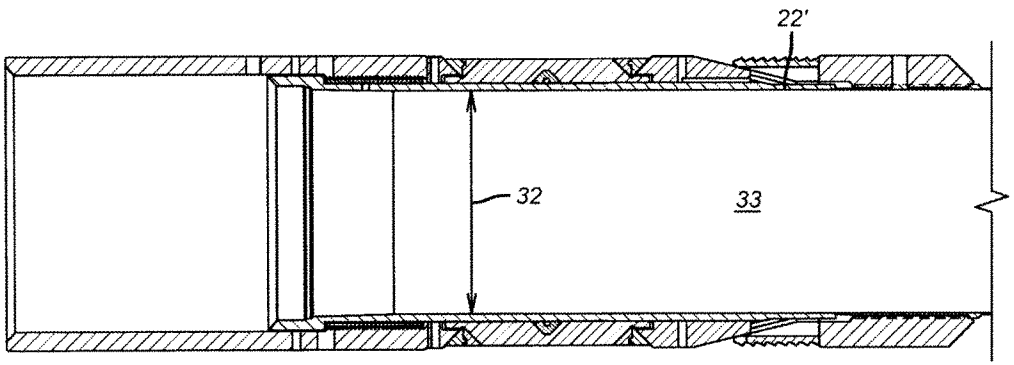
FIG. 3 is the tool of FIG. 2 showing the sleeve removed leaving a large passage through the thin mandrel to enhance production flow after fracturing is complete.

FIG. 3 shows the addition of a controlled electrolytic material (CEM) sleeve 30 to the mandrel 22'. The wall thickness of the mandrel 22' is substantially thinner than the wall thickness of the mandrel 22. The reason for this is that mandrel 22' will only need to resist the tension loading of the set packer 10'. The collapse resistance, which is needed during fracturing but not during production is provided by the CEM sleeve 30. Sleeve 30 has, as all sleeves do an interior wall surface 31 that defines a flow path 33 therethrough as well as an outer wall surface 35 in this case against the mandrel 22". While the preferred material is CEM because of its ability to disappear under the appropriate environment conditions other materials that disappear such as with chemical reactions or thermal exposures could also be used as alternatives. Another alternative would be materials that can selectively change shape so that they can stay in the FIG. 3 position when needed for collapse resistance and then be moved out of the way after a shape change so that they can drop to the hole bottom or to below the lowest producing zone or even to a bigger section of the string where there will later be minimal interference with production flow. Shape memory alloys could be used for such an application and made to change shape when crossing the critical temperature. While the fracking was going on the sleeve 30 stays in the FIG. 3 position to provide resistance to collapse and flow path 33 is in an original smaller dimension. After the fracking is concluded the sleeve 30 is removed enlarging passage 33 and leaving behind the thinner wall of mandrel 22' which can have an effect of making diameter 32 of enlarged passage 33 more than 20% larger than initial diameter 34". The redesigned mandrel 22' just needs to tolerate the setting tension load of about 30,000 to 50,000 pounds of force. The remaining components of the packer 10 on the exterior can be used in the FIGS. 3 and 4 design making the present invention an easy retrofit with existing equipment by requiring a simple redesign of the mandrel 22' and the associated sleeve 30.

What is shown is a simple solution to a pressure rating issue that is transient with the same element also solving the flow through issue that occurs at a discrete time and happens to be solved with removal of the same element that solved the previous problem. This concept can be applied in a variety of tools at surface or subterranean locations.

The sleeve can be secured using a press fit, adhesive or threads or any other type of fastener. The support sleeve can be all the same material or a variety of materials that can serve the function of collapse support while being readily removable in a variety of the above described ways.

The above description is illustrative of the preferred embodiment and many modifications may be made by those skilled in the art without departing from the invention whose scope is to be determined from the literal and equivalent scope of the claims below:

We claim:

1. A tool for subterranean use, comprising: a packer body having a passage therethrough and a seal and at least one slip on the exterior of said body selectively engageable with a surrounding borehole wall;

a support member disposed in said passage and axially extending the substantial length of and aligned with at least one of said seal and said slip to enhance differential pressure resistance of said body in at least one of burst and collapse pressure loading while leaving a flow path in said support member open when run in and when said seal or slip is radially extended to the surrounding borehole wall; said support member selectively removable from said passage by exposure to fluids in the borehole and after said seal and said at least one slip have radially extended to the borehole wall with said body remaining intact and said seal and slip engaged to the borehole wall for zone isolation for subsequent enlargement of said passage at said location.

2. The tool of claim 1, wherein:
said support member has a tubular shape.

3. The tool of claim 2, wherein:
said support member is removed by dissolving.

4. The tool of claim 2, wherein:
said support member is removed by heat.

5. The tool of claim 2, wherein:
said support member is removed by a shape change.

6. The tool of claim 2, wherein:
said support member is made at least in part from CEM.

7. The tool of claim 2, wherein:
said support member is made at least in part from a shape memory alloy.

8. The tool of claim 1, wherein:
said passage in said body is defined by a mandrel;
said support member is surrounded by said mandrel.

9. The tool of claim 8, wherein:
said support member is press fit into said mandrel.

10. The tool of claim 8, wherein:
said support member is configured to resist transient collapse loads which allows said mandrel to be designed to resist stresses imposed when the tool is in a set position but not said collapse loads, said collapse loads exceeding said stresses imposed when the tool is in a set position.

11. The tool of claim 8, wherein:

removal of said support member combined with a corresponding reduction in wall thickness for said mandrel enabled by the initial presence of said support member allows a resulting passage diameter that is at least 20% larger than using only the mandrel for differential pressure resistance in at least one of burst and collapse pressure loading.

12. The tool of claim 11, wherein:

said support member has a tubular shape.

13. The tool of claim 12, wherein:

said support member is removed by dissolving.

14. The tool of claim 12, wherein:

said support member is removed by heat.

15. The tool of claim 12, wherein:

said support member is removed by a shape change.

16. The tool of claim 12, wherein:

said support member is made at least in part from CEM.

17. The tool of claim 12, wherein:

said support member is made at least in part from a shape memory alloy.

18. The tool of claim 12, wherein:

said support member is press fit into said mandrel.

19. A reinforcing method for a borehole isolation device, comprising:

providing a packer body having a passage therethrough and a seal and at least one slip on the exterior of said body selectively engageable with a surrounding borehole wall;

inserting a support member extending the substantial length of and aligned with at least one of said seal and said slip in said passage and axially aligned with at least one of said seal and said slip to enhance differential pressure resistance of said body during a borehole treatment in at least one of burst and collapse pressure loading while leaving a flow path in said support member open when run in and when said seal or slip is radially extended to the surrounding borehole wall;

after said treatment, selectively removing said support member from said passage by exposure to fluids in the borehole and after said seal and said at least one slip have radially extended to the borehole wall and with said body intact and said seal and slip engaged to the borehole wall for zone isolation for enlargement of said passage at said location to pressurized flow through said passage and said tubular string.

20. The method of claim 19, comprising:

making said support member from a controlled electrolytic material or a shape memory alloy.

21. The method of claim 19, comprising:

triggering said removing thermally or chemically.

22. The method of claim 19, comprising:

performing formation fracturing as said treatment.

* * * * *